US006217447B1

(12) United States Patent
Lofink et al.

(10) Patent No.: US 6,217,447 B1
(45) Date of Patent: Apr. 17, 2001

(54) METHOD AND SYSTEM FOR GENERATING DISPLAYS IN RELATION TO THE PLAY OF BACCARAT

(75) Inventors: Kurt Lofink; Richard Lofink, both of Las Vegas, NV (US)

(73) Assignee: DP Stud, Inc., Las Vegas, NV (US)

( * ) Notice: Subject to any disclaimer, the term of this patent is extended or adjusted under 35 U.S.C. 154(b) by 0 days.

(21) Appl. No.: 08/792,277

(22) Filed: Jan. 31, 1997

(51) Int. Cl.[7] ..... A63F 9/22; A63F 15/00
(52) U.S. Cl. ..... 463/12; 273/292
(58) Field of Search ..... 463/10, 11, 12, 463/31, 40, 43, 47, 16; 273/292

(56) References Cited

U.S. PATENT DOCUMENTS 4,467,424 * 8/1984 Hedges et al. ..... 463/40
4,531,187 * 7/1985 Uhland ..... 463/12
4,926,327 * 5/1990 Sidley ..... 463/42
5,127,651 * 7/1992 Okada ..... 273/143 R
5,397,133 * 3/1995 Penzias ..... 463/40
5,722,893 * 3/1998 Hill et al. ..... 463/47
6,062,979 * 5/2000 Inoue ..... 463/12

* cited by examiner

*Primary Examiner*—Jessica J. Harrison
(74) *Attorney, Agent, or Firm*—Quirk & Tratos

(57) ABSTRACT

A method and system for generating displays related to the play of Baccarat is provided. Cards dealt to each of the Banker's and Player's hands are identified as by scanning and data signals are generated. The card identification data signals are processed to determine the outcome of the hand. Displays in various formats to be used by bettors are created from the processed identification signals including the cards of the hand played, historical records of outcomes and the like. The display can also show bettors expected outcomes and historical bests. Bettors can refer to the display in making betting decisions.

28 Claims, 4 Drawing Sheets

METHOD AND SYSTEM FOR GENERATING DISPLAYS IN RELATION TO THE PLAY OF BACCARAT

FIELD OF THE INVENTION

This invention relates to systems and methods for generating displays in relation to the play of Baccarat including historical records of the outcomes for hands of play.

BACKGROUND

Baccarat is one of the many popular live table games played in casinos or gaming establishments. Baccarat uses a standard deck of fifty-two cards and is usually dealt from a shoe having multiple decks (commonly eight) that have been shuffled together and loaded into shoe for dealing prior to the beginning of play of a round of hands.

The object of the game of Baccarat is for the bettor to successfully wager on whether the Banker's hand or the Player's hand will win the hand of play. Bettors have no discretion concerning the play of the hands, since cards are dealt according to pre-established rules. Their options prior to the dealing of a hand of Baccarat are to not bet, bet with either the Banker hand or the Player hand and/or to wager that the hands will tie. In some establishments an additional wager is allowed, which is to wager that either the Banker hand or the Player hand will be a Natural, i.e. a two card total, modulo 10, of 8 or 9.

Bettors playing Baccarat like to track the hands of play for a shoe starting with the first hand decision out of a shoe. Unlike the game of Craps or Roulette where historical decisions are not divided by an event like shuffling cards and loading a shoe, Baccarat does have starting and ending points, i.e. first hand and last hand dealt from the shoe, respectively. This may be significant to the bettor, as the recordation of the historical outcomes of each hand may indicate the future outcomes for the remaining hands to be dealt from the shoe.

It is known for bettors to notate on paper a running record of the outcomes of hands. Typically bettors note whether the hand was won by the Banker or Player hand, whether the win was by a Natural, and whether the hand was a Tie. By keeping a running record, the bettor may perceive tendencies to help them decide how to wager on the next hand. For example, if the Banker hand has won five consecutive hands, the bettor may decide to wager on the Player hand on the next deal perceiving that the Player hand is due to win. Conversely the bettor may determine that it is best to go with the winning streak and wager on the Banker hand. Thus, many players attribute great significance to the historical outcomes of a shoe in Baccarat and based thereon develop strategies in deciding how and when to make a wager. Typically bettors notate when a new shoe is started for the reason stated above.

In manually tracking outcomes, bettors may simply notate the outcomes in chronological sequence or may notate trends in a column format. Trend notation, as it is to be hereinafter understood, is where a bettor notes, for example descending in a first column, "BBB" (indicating three consecutive wins for the Banker). If the Bank wins the next hand, another "B" would be notated, in descending order below the "BBB", in the same column. However, if the Player wins the next hand, the notating bettor would move over to the next column and notate a "P". Thus, notation in the column continues in descending (or ascending) order until the trend stops, i.e. the other of the Banker or Player wins. When the trend ends by the other of the hands winning, the bettor moves over to the next column to begin notation.

A drawback of bettors notating outcomes is that a new bettor to the game has no developed history to refer to in making a wager. Bettors are typically very engrossed in diagnosing their recorded information and consider it distracting to share their historical record with a new player. Furthermore the new bettor may not use the type of notation of the other bettors. This makes new bettors reluctant to join a game in progress or at least until a new shoe starts. Still further, for bettors having a system for wagering on Baccarat, they may watch or sit out numerous hands until the outcome history favors the bettor's system. These factors may cause bettors not to play which, in turn, represents lost revenue opportunities for the casino.

Some establishment do provide a pillar display which indicates the last 20–30 hand decisions, in descending sequence, the Banker and Player wins, Ties and Naturals. For those tables having the pillar display, the dealer inputs the outcome. A drawback of this technique is that the accuracy of the historical record of outcomes depends entirely upon the accuracy of the input. If the dealer makes a mistake or fails to input an outcome, the entire history displayed on the pillar is subject to question. If bettors perceive that the history is inaccurate, they may have to manually notate outcomes or may opt to leave the game. This places a burden on the bettors to check the accuracy of the historical record of the pillar display with their own record, thus eliminating the purpose for providing the pillar display. The pillar display also places a burden upon the dealer to correctly and promptly input outcomes. A further drawback is the pillar display does not display in a trend notation. For these bettors using trend notation, they must keep their own record. An additional drawback is the pillar display is that it is limited by the number of decisions it displays and thus often is unable to communicate the entire historical record of the shoe. This is important for the bettors that use the first half of a shoe to determine betting opportunities in the second half of the same shoe.

A further drawback related to the play of Baccarat is the rules by which the third cards are dealt to the Banker and/or Player hands. These rules are unfamiliar to novice bettors and follow no basis of common logic. Related to this drawback is the way the total of the hand is determined. Aces count one; Kings, Queens, Jacks and Tens count zero and all other cards count their respective face value. The calculation of hand totals, modulo ten, and understanding of game rules would not be apparent to new bettors, thus creating a resistance to playing the game. While brochures and textual materials are available, new bettors without some additional assistance, may find the game to intimidating. These drawbacks effect the fun and excitement associated with playing Baccarat as well as the ability to draw new and novice players to the game.

There is a need in the gaming industry to increase the amount of revenues being generated by Baccarat tables over a given period of time without simply requiring bettors to increase the amount of their wagers. This can be obtained by encouraging additional play from experienced bettors, making the game easier to play and understand, and thus creating new play from new and/or novice bettors.

SUMMARY OF THE INVENTION

The present invention is directed to a Baccarat tracking system and method which overcomes the drawbacks of player recordation of outcomes and pillar displays, which frees the players to concentrate on their strategy concerning the game, which makes the game easier to play and more understandable and which is capable of providing a wide variety of historical outcome information in various formats which can be referred to by bettors in making their wagering decisions.

According to the present invention a system is set forth for generating a display which includes means for identifying the cards dealt to the Player and Banker hands. Where the system is incorporated into a live action table game the system has a card reader which generates data signals corresponding to the denomination of each card dealt to each of the Banker and Player hands during a hand of Baccarat. A processor receives the data signals, processes the signals to determine whether the Banker or Player has won the hand, stores the outcome in a data register and drives a display to display, in various selected formats, the outcomes.

In a further embodiment for live action table games, the reader is adapted to read the suit and denomination of the cards to provide, if desired, a display representing the cards of each of the hands during play.

In still a further embodiment, the processor in response to reading the cards dealt recalls from stored memory and displays the corresponding rules of play, including rules of play which govern when the Player and/or Banker hand receives a third card. Thus the bettors can see the application of the rules during play which helps educate the bettors.

In still a further embodiment, the processor can be pre-programed to, when the game is not being played, display information and/or images for educational, advertising or entertainment purposes.

In still a further embodiment, because outcomes are stored, the processor is adapted to determine historical "bests" for a shoe such as longest Banker trend, longest Player trend and the like. Further the processor is programmed to compare certain outcomes to those which would be mathematically expected for a shoe. As but an example, the processor can compare actual outcomes and display how many Banker or Player Naturals and ties would be mathematically expected up to this point of play from this shoe.

The method of the present invention includes identifying the cards dealt and displaying a historical record, in various formals, of the outcomes.

The system and method of the present invention provides an accurate record of outcomes since input by a dealer is not required. This also frees the dealer from the task of inputting. Furthermore, the processor is programmed to provide various displays used by players including not only various outcome record formats, but the cards of the hands dealt and, if desired, the rules of drawing third cards, historical "bests" and/or expected outcomes.

Other objects, features, and advantages of the invention should be apparent from the following description of the preferred embodiment as illustrated in the accompanying drawing.

DESCRIPTION OF THE PREFERRED EMBODIMENT

While the description hereinafter set forth is described in connection with a live action table game of Baccarat, it is to be understood that it could also be used in electronic gaming machines.

Figure 1:
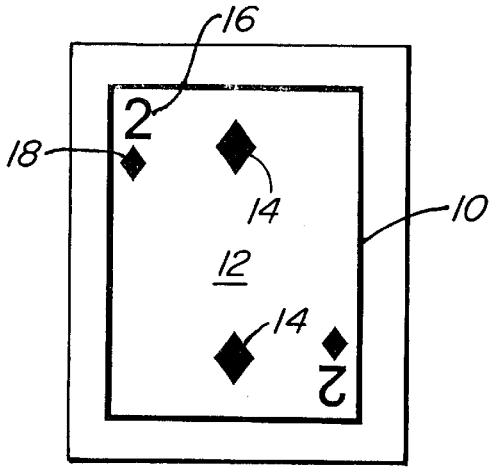
FIG. 1 is a plan view of a card that is used in the preferred embodiment of the present invention.

As shown in FIG. 1, the face of a card 10 which is a two of diamonds, is shown having a typically white background portion 12, pips 14 as well as, in opposite corners, a numeral 16 and suit designator 18. Other cards of the deck are, as is well known, distinguishable by their pips (diamond, clubs, hearts and spades), number and arrangement of the pips, the pictures of picture cards, i.e. Kings, Queens and Jacks as well as their corner marked numerals, or letters for picture cards, and suit designator. Suffice it to say each card of the deck is visually distinguishable from different cards by virtue of the cards markings.

Figure 2:
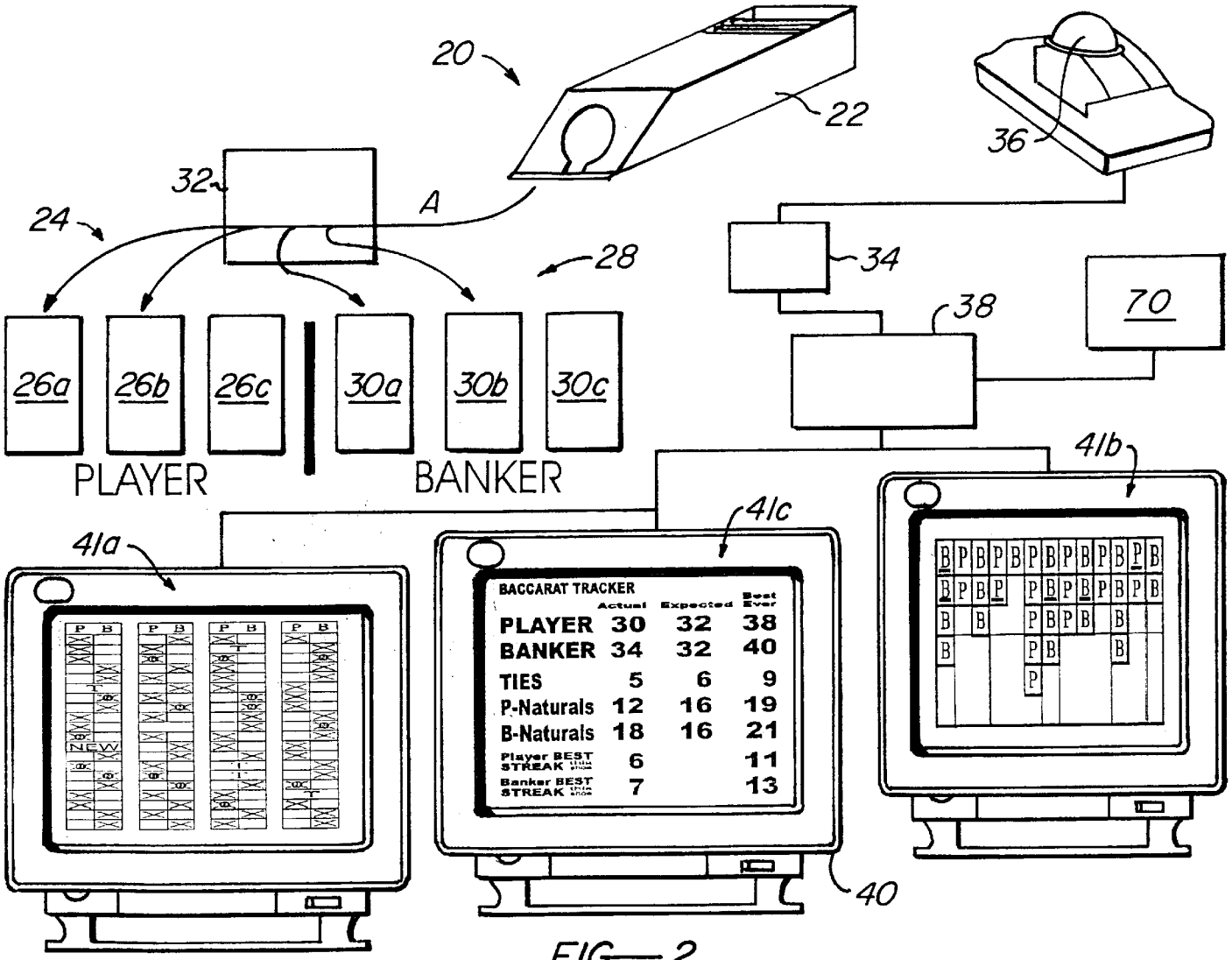
FIG. 2 is an illustration of a system according to the present invention.

With reference to FIG. 2 the system 20 according to the present the present invention will now be described.

Cards 10 are shuffled and loaded into a dealing shoe 22 for dealing to the bettors playing the game. The Baccarat table includes a Player hand area 24, which may include three card locations 26*a–c* each for locating a card dealt to form the Player's hand. Similarly there is Banker hand area 28 with three card locations 30*a–c* to position the cards dealt to the Banker hand. Not shown, but as is well known, are places on the table for bettors to wager on the Player hand, Banker hand, ties and in some establishments, that the outcome will be a Natural, i.e. a winning hand of 8 or 9.

Disposed between the shoe 22 and areas 24,26 is means for identifying the cards dealt to the Player and Banker hands. These means are embodied as any suitable card scanner 32. Scanner 32 optically scans each card 10 as it is dealt from the shoe 22 and swiped across the scanner 32, face down. When the cards 10 inclulde a bar code (not shown) on their face which designates suit and denomination, the scanner 32 may be a laser scanner adapted to generate signals corresponding to the bar code. Preferably, to avoid the necessity of bar coding cards, the scanner 32 is of the type which optically scans the card face and generates data signals corresponding to the optical characteristics of the face of the card. As but an example, digital camera means can be used to generate data signals, broken in picture elements, i.e. pixels, the signal strength at the locations of the individual pixels collectively corresponding to the actual appearance of the face. These signals which may be for the entire face of the card 10 or a portion, i.e. half of the card or the corner of the card, are issued by a suitable data link to a processor 34.

Accordingly, as the dealer deals cards from the shoe 22 they are each passed over the scanner 32, face down (as shown at A), to be read before positioning in the appropriate hand areas 24,28. Since the cards are dealt in strict sequence, first card to the Player, next to the Banker, next to the Player and next to the Banker, the data signals generated by the scanner 32 are processed to allocate the scanned cards to the appropriate Banker or Player hand.

The processor 34 is programmed to receive the data signals from the scanner 32 and to process them to create data corresponding to at least the denomination of the card 10 as it is dealt. Since the suit of the card 10 dealt is not important in Baccarat, it need not be determined. Preferably, processor 34 is programmed to create data signals corresponding to both the denomination and suit of the card 10 dealt for purposes which will hereinafter become evident. Processor 34 compares the data signals from the scanner 32 to a stored database contained therein of data corresponding to each of scanned areas of the fifty-two playing cards. Thus as each card is read, the data signals are compared to stored data to find a concordance between the stored data and the scanned data to determine the suit and denomination of the card scanned. The determined card identification data is stored in memory.

After each card is scanned and determined, the next card 10 is dealt and scanned and determined in a similar fashion. An audible or visual signal may be provided to tell the dealer that the scanned card has been read and identified or conversely has not been identified. If the card 10 is not identified on the initial swipe the audible or visual signal will tell the dealer to re-swipe the card 10 to be re-scanned. If the card, for whatever reason cannot be identified by the processor 34, the dealer can manually input the card 10 suit and denomination by a keypad or mouse (not shown) or by a table mounted control ball 36. By inputting a suitable prompt, the game display as described below, will display the field or all fifty-two playing cards by suit and ascending or descending sequence. The dealer using the control ball 36 would move a pointer or cursor on the display to the appropriate card on the display and use an prompt to enter the card identification into the processor 34. After entry of the cards identification, the card is placed in the appropriate area 24,28.

In that the shape, arrangement and color of the pips 14 and face card pictures or corner notations may vary between card manufacturers, it may be necessary to condition the processor 34 to read the cards 10 correctly by passing cards 10 over the scanner 32 and confirming that they have been correctly read. Where the processor 34 incorrectly reads or cannot read a card 10, the attendant or dealer can use the control ball 36 in the manner described above to change the stored card identification data to accurately identify the cards 10 as scanned by the scanner 32. In this manner the processor 34 can receive and store data to match the signals from the scanner 32 with card identification data.

Processor 34 includes a data register to which the processor stores the card identification data and arranges the data by Player hand and Banker hand. After four cards 10 have been dealt and scanned, processor 34 recalls the stored data from the data register, identifies the cards dealt to each hand and calculates the total, according to the rule of Baccarat, for each of the Player hand and Banker hand. As can be appreciated, processor 34 is also programmed to perform the aforementioned calculations.

Processor 34 is also programmed to determine, under the rules of Baccarat, when third cards are to dealt to complete the Player and Banker hand. These rules depend on the totals, modulo ten, of the first two cards of each of the Banker hand and Player hand. In play, the dealer dealing the cards turns the hand over for the bettors to see the two card totals and based upon the hand totals, modulo 10, deals third cards to either or both of the hands. These rules of third card drawing are well known and will not be repeated herein. Thus processor 34 withholds a final hand totals calculation until all hands have been completed.

When the hands have been completed, processor 34 calculates the totals for the hands and compares them to determine whether the Banker or Player won the hand or if it was a tie. Processor 34 also determines whether the winning hand was a Natural. The identity, Banker or Player, of the winning of the hand and whether the winning hand was a Natural or whether the hand was a tie is stored in memory. The stored outcomes are stored in order of play.

Figure 3:
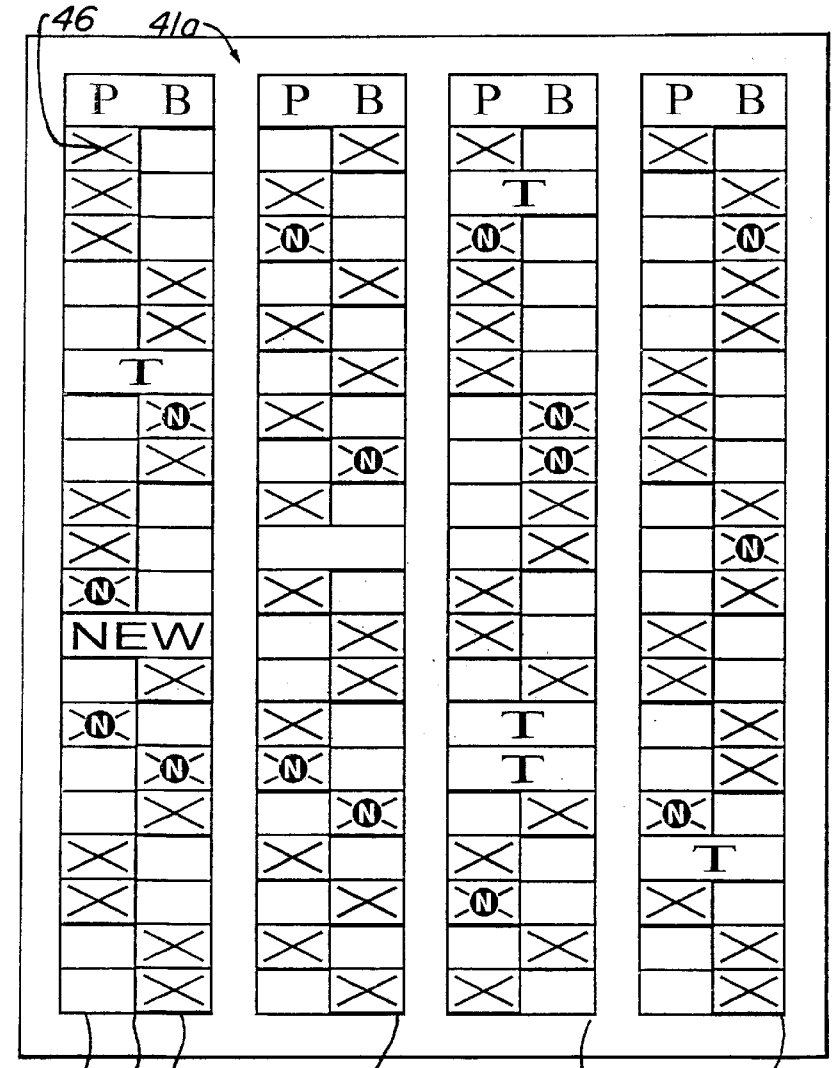
FIG. 3 is a column display of the history of outcomes for Baccarat according to one aspect of the present invention.

Processor 34 is linked to a video display driver 38 of a type well known in the art. The driver 38 is in turn linked to a monitor or display 40 shown in three different display modes in FIG. 2. Processor 34 and/or driver 38 is preprogrammed to generate video displays of the historical outcomes of the game in several formats. With reference to FIG. 2 and 3, the display or outcomes may be in what is to be understood herein as a column display 41*a*. Column display 41*a* includes a plurality of vertical columns 42 each divided into two sub-columns 44*a,b*. Sub-column 44*a* is for notations of winning Player hands and according is appropriately titled with a "P". Sub-column 44*b* is for winning Banker hands and is also appropriately titled "B" as illustrated.

In this display mode, as each outcome is determined, processor 34 issues a notation 46 such as an "X", with or without a distinguishing color background, into the appropriate sub-column 44*a,b* and in descending, right to left order. That is, as each outcome is determined, the notation 46 is placed immediately below the notation 46 of the previous outcome. As each column 42 is filled, the notation 46 is next placed at the top of the column 42 immediately to the right of the filled column 42.

As also shown in FIG. 3, where the outcome is a tie, that too is appropriately notated with, for example, a "T" placed between the sub-columns 44*a,b*. Further, where the winning hand was by a Natural, that notation can be included as well by the processor 34 driving the display 40*a* to show an "N" in the appropriate sub-column 42*a,b* for the hand winner.

Further, the beginning of a new shoe can also be displayed. By using the control ball 36 or other suitable prompt the dealer provides a signal representation of the beginning of the shoe to processor 34. Processor 34 issues data to drive the display 42*a* to display a notation such as the word "NEW" at the appropriate position in the column display 42*a*.

Figure 4:
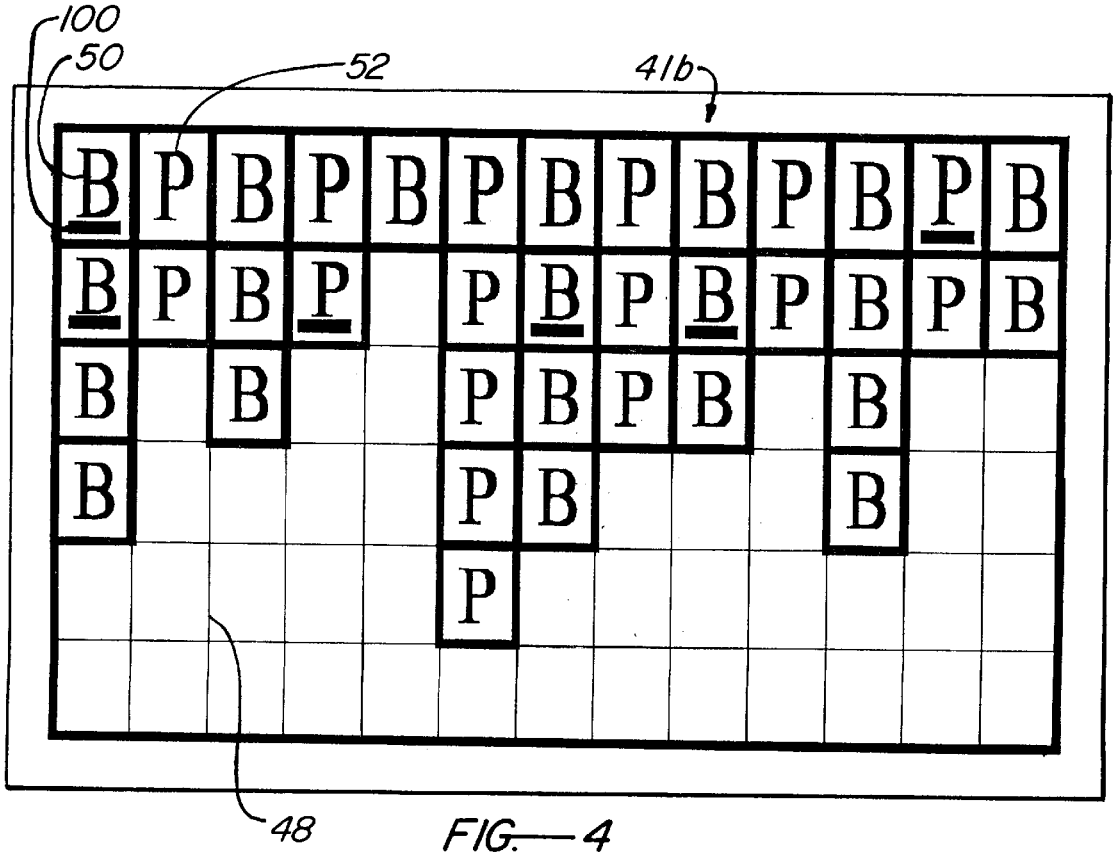
FIG. 4 is a trend display of the history of the outcomes for Baccarat in a trend format according to the present invention.

With reference to FIGS. 2 and 4 the mode of the outcome trend display 41*b* will now be described. Processor 34 and/or driver 38 control the display 41*b* to display a grid 48. The first outcome of a new shoe is located by a suitable notation, "B" or "P", in the upper left corner of the grid 48 as at notation 50. As illustrated, the next three winning outcomes (the trend display does not notate ties) were for the Banker and according are indicated by notations vertically descending from notation 50 as shown by the three "B"s. The next winning decision, however was for the Player. since the Banker winning trend has stopped, the processor 34 drives the display 41*b* to issue a notation 52 shown as "P" at the top of the next column to the right. Thus notations are made in vertical descending (or ascending) progression in a column until the winning streak or trend for the Banker or Player stops. This type of trend or streak display 41*b* is commonly utilized by bettors. At the end of the shoe, the notations on the grid would be erased since trend tracking is only perceived as relevant for each shoe. If desired those hands winning by Naturals could be notated by underlining 100 as shown if FIG. 4.

A tally mode of display 41*c* will now be described with reference to FIGS. 2 and 5. According to this mode of display, processor 34 and/driver 38 drives the display 41*c* to display in corresponding rows and for each shoe a running tally of wins for the Banker and Player, Ties and wins by Naturals. Thus at ihe beginning of each shoe, the foregoing information would be zeros and would be updated during play.

Figure 5:
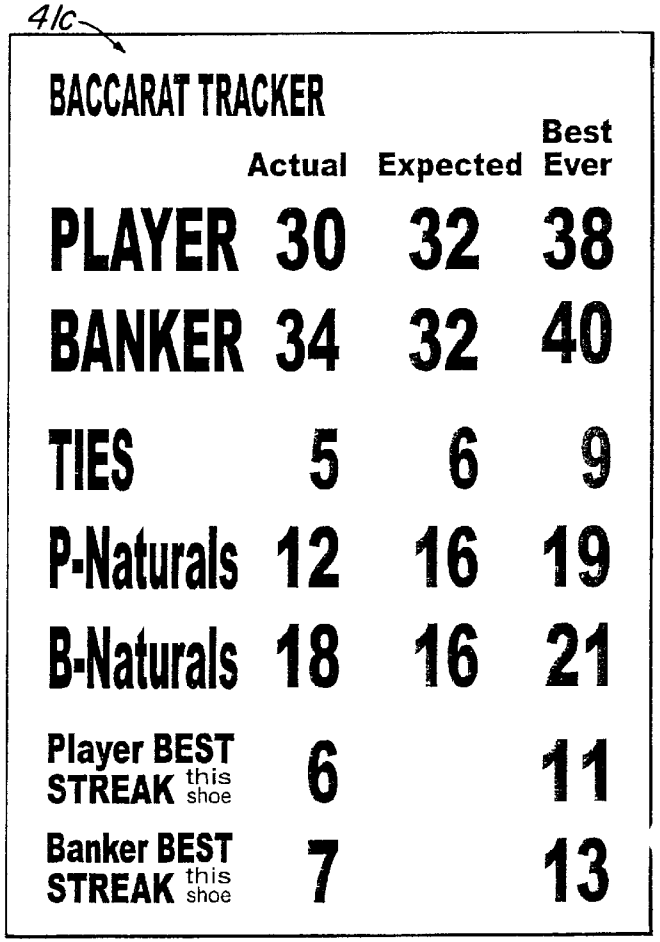
FIG. 5 is a tally display of the history of outcomes for Baccarat according to the present invention in a summary format.

With continuing reference to FIG. 5, the tally display can also be used to display other information which may be of use to bettors. Since the probabilities of ties, Banker wins, Player wins and wins by Naturals for any given number of outcomes is known, processor 34 is programmed to drive the display 41*c* to display in a column identified in FIG. 5 as "EXPECTED" those probabilities. At the start of the shoe, these expected quantities are zero. However as a sufficient number of outcomes occur, the expected number of particular outcomes for the number of decisions having occurred from the shoe can be displayed. As but as example, a tie, according to probabilities, would be expected to occur in approximately every ten outcomes. Thus after ten decisions or outcomes if there has been no tie, the display 41*c* would show a "1" in the EXPECTED column in the ties row.

With continuing reference to FIG. 5, the tally display can also display the number of the Player's and Banker's best streak up to the last outcome for the shoe.

Furthermore, because the processor 34 stores outcomes, it can be programmed to track the best ever (for the establishment) Player or Banker wins in a shoe, ties in shoe, Naturals and streaks in any shoe. This information would enable bettors to compare the decisions of this shoe with the best ever. Further such information may entice bettors to bet with streaks or make proposition wagers, i.e. ties and Naturals.

A single display or multiple displays may be used at the table. Where a single display 40 is used, the display 40 may sequence through the various modes of display 41*a–c* for bettors to use the display 41*a–c* of their choosing in making their wagering decisions. Alternatively all modes of display 41*a–c* could be shown simultaneously by allocating display screen space for each mode. Depending upon the bettors wishes, the dealer by using the control ball 36, could select a single mode of display 41*a–c*.

Figure 6:
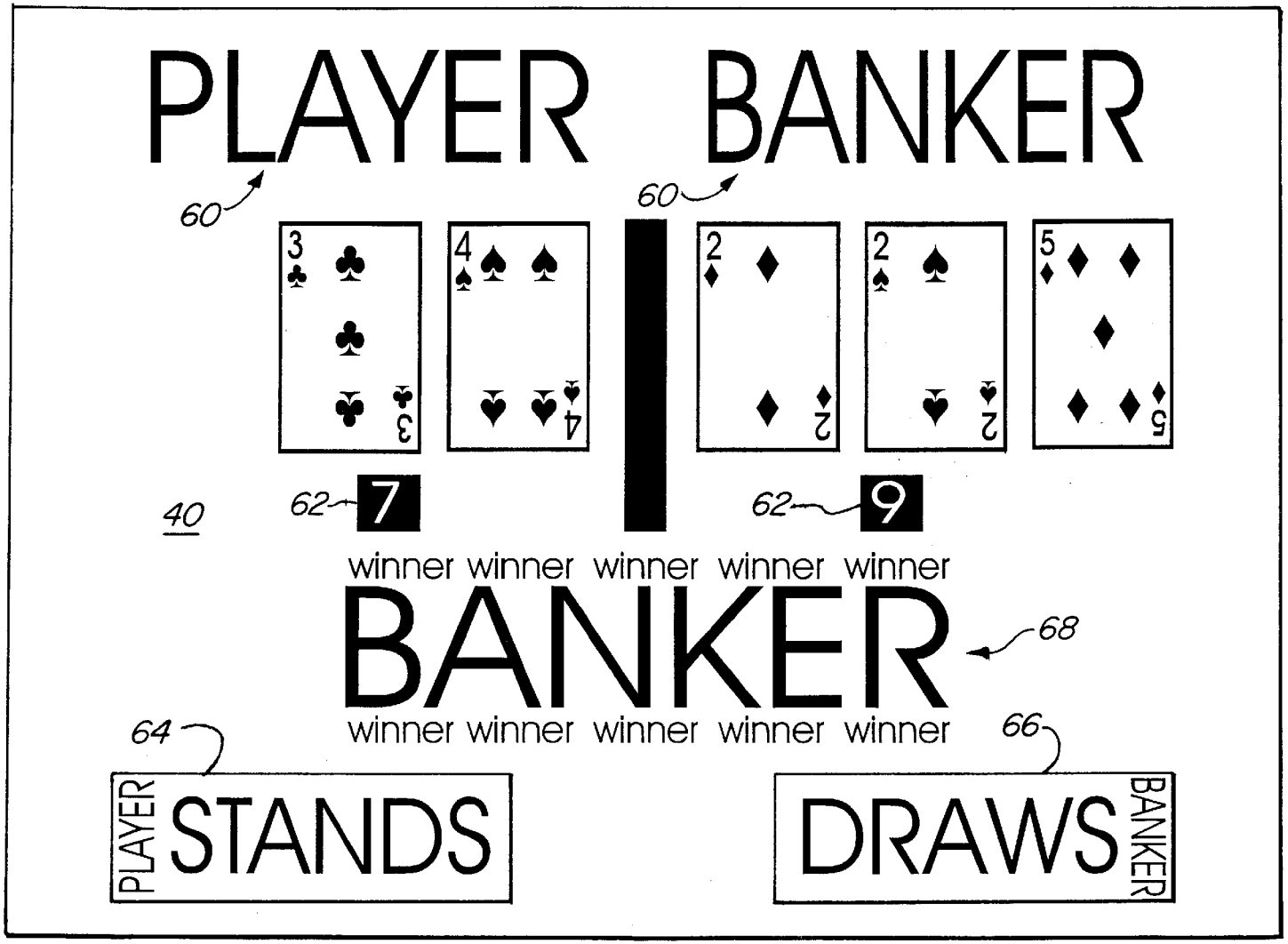
FIG. 6 is a further display of the method and system according to the present invention showing hands of play and Baccarat draw rules.

Referring to FIG. 6, an additional mode of display is shown. According to this embodiment, the processor 34 drives the driver 38 to display at display 40 representations of the denomination and suit of each card as it is dealt to each of the Banker and Player hands. In that the scanner 32 and processor 34 cooperate to identify the cards, processor 34 can be programmed to issue signals to display representations of the cards as they are dealt. As shown in FIG. 6 by way of example, the display 40 for a hand shows a three of clubs and a four of spades dealt to the Player and a two of diamond and a two of spades dealt to the Banker. The display 40 would indicate as by headers 60 which hand is which.

Below the cards forming each hand is a total 62, modulo ten, for each hand. Thus the bettors can confirm the totals of the cards dealt by referring to the display 40. Also displayed are panels 64,66 which indicate the action of the hands according to the rules of Baccarat based upon the two card totals. Panel 64 on the display 40 shows that for a total of seven, the Player stands. However for a two card total of four, the Banker draws, i.e. is dealt a third card. As the third card is dealt, it is displayed at the display 40 as are final hand totals 62. Further the nature of the outcome, Banker or Player win, tie or Natural can also be displayed at the display 40 at a screen location 68.

As stated above, the dealer can select which of the display modes the bettors prefer. For example the bettors may wish not to know the cards of the hands before they are turned over by the dealer and accordingly the dealer would de-select the presentation of FIG. 6. In establishments where cards are dealt face up, this may not be important. Where bettors are unfamiliar with the totalization or draw rules of Baccarat, they may prefer the display mode of FIG. 6. Further the processor 34 and/or driver 38 can be programmed to sequence through the various display modes to provide the above described information to bettors.

As can be appreciated the system and method described above relieves the dealer of having to input outcomes, provides for the display of outcome information in various formats and provides game information heretofore unavailable. Because outcomes are stored in memory, more outcomes can be displayed. The outcomes of multiple shoes could be displayed by simply providing more columns in the column display format. Still further, the information provided may entice proposition wagers and the like by players based upon the information provided.

As a further feature, the system of the present invention shown in FIG. 2 can also include a video player 70 coupled to the display 40 or the driver 38 therefor. When there are no bettors and no play at a table, the video player 70 can be used to display at the display 40 rules of the game, advertisements or other information to patrons.

The system and method according to the present invention can be practiced in either the live game version described above or in an electronic gaming machine version. An electronic gaming machine can be preprogrammed to display both the Player and Banker hands and to permit the bettors to wager in a manner similar to that of live action Baccarat. The cards as randomly selected by the machine processor are identified, hand totals are calculated and winning hands (or ties) are determined. The gaming machine would be programmed to assign screen space and display at least one of the outcome display formats 41*a–c*. Thus the bettor playing the machine will have a historical outcome basis for making their next wager.

While the invention has been particularly shown and described with reference to a preferred embodiment thereof, it should be understood by those skilled in the art that changes in form and detail may be made therein without departing from the spirit and scope of the invention.

We claim:

1. A system for generating a display for the player(s) to see at a Baccarat game where playing cards are dealt to form a Banker's hand and a Player's hand comprising:

means for identifying each card as it is dealt to the hands and to generate data signals identifying each card dealt to each hand;

a video display disposed for viewing by at least the Player(s);

a processor pre-programmed to process said data signals according to the rule of Baccarat to determine the nature of the outcome as either (i) a Banker hand win, (ii) a Player hand win, or (iii) a tie and to control the video display to display a representation of the historical outcomes for a succession of hands.

2. The system of claim 1 wherein the processor drives the display to display a double column format, one column designated for Banker wins and the other designated for Player wins, said processor controlling the display to position an indicator of each outcome in sequence to the appropriate display column.

3. The system of claim 2 wherein the processor is programmed to identify on the display hands won with a Natural.

4. The system of claim 3 wherein the processor is programmed to identify ties on the column format.

5. The system of claim 1 wherein the cards are dealt from a shoe containing a plurality of decks of cards, the system further including means for determining the beginning of a shoe and for generating a signal in response thereto, the processor receiving said signal from the determining means and driving the display to display an indication of a new shoe.

6. The system of claim 1 wherein the processor drives the display to display the outcomes in a streak format.

7. The system of claim 1 wherein said processor displays the outcomes in a tally format.

8. The system of claim 1 wherein said processor is adapted to control the display to display the outcomes in at least one display selected from a group consisting of a column format, a steak format or tally format.

9. The system of claim 1 for a live action game, said identification means including a reader adapted to read and generate signals indicative of at least the denomination of the cards dealt.

10. The system of claim 9 wherein said reader is adapted to read and generate data signals corresponding to the suit and denomination of the cards dealt.

11. The system of claim 10 wherein said processor controls the display to display representations of the cards dealt to each of the Banker and Player hands.

12. The system of claim 11 wherein said processor is adapted to calculate the totals of the Banker and Player hands as the cards are dealt and controls the display to display said totals.

13. The system of claim 12 wherein said processor is preprogrammed to display, as hand totals are calculated, the appropriate rules as to when either hand is to draw a third card.

14. A system for generating a display concerning a Baccarat card game played by dealing playing cards to form a Banker's and a Player's hand comprising:

means for identifying the cards dealt to the hands and to generate data signals corresponding to a least the denomination of each card dealt to each hand;

a video display unit; and a processor preprogrammed to process said data signals according to the rules of Baccarat to determine the nature of the outcome as either (i) a Banker hand win, (ii) a Player hand win, or (ii) a tie and to control the video display to display a representation of the historical outcomes for a succession of hands in at least one of a column, streak or tally format.

15. The system of claim 14 wherein the game is a live action game, said identification means including a scanner adapted to scan at least a portion or a card dealt to the hands and generate data signals indicative of at least the denomination of said cards.

16. A method for providing a display in relation to the play of Baccarat where cards are dealt to a Player and a banker hand comprising:

scanning the cards as they are dealt to each of the Player and Banker hands and generating data signals corresponding to the denomination of said cards;

processing said data signals to determine the cards dealt to each hand, to calculate the hand totals and to determine the outcome selected from (i) which of the Banker or Player hands won, (ii) if there was a tie or (iii) if the win was with a Natural; and from said processed data signals displaying the outcomes for a series of hands.

17. A method for displaying the historical outcomes for Baccarat where cards are dealt to a Player and Banker hand comprising the steps of:

determining the cards dealt to each hand and providing card signals to a computer, said card signals being representative of said dealt cards;

causing said computer to generate a signal representation of an outcome of said game according to the rules of Baccarat; and providing a display of an indication of a series of said outcomes in response to said outcome signal representation.

18. The method of claim 17 wherein the game is played as a live action table game where cards are dealt by a dealer, said determining step including scanning the face of the cards as they are dealt to the Player and banker hands and generating data signals corresponding to the identity of each card so dealt.

19. The method of claim 18 further including displaying representations of the cards dealt to each hand.

20. The method of claim 19 further including displaying a representation corresponding to the rules of Baccarat when third cards are dealt to either the Player or Banker hand when such third cards are to be dealt.

21. The method of claim 17 wherein the providing step includes providing a column display of outcomes.

22. The method of claim 17 wherein the providing step includes providing a trend display of outcomes.

23. The method of claim 17 wherein the providing step includes providing a tally display of outcomes.

24. The method of claim 17 further including displaying prerecorded information when said game is not in play.

25. A system for displaying information during the play of Baccarat where cards are dealt to a Dealer's hand and to a Player's hand, said system comprising:

means for identifying the cards as they are dealt to each hand and generating data signals corresponding thereto;

a video display disposed for viewing by at least the Player(s);

a data processor to receive said data signals and in response thereto (i) to control the display to display representations of the cards as they are dealt to each hand, (ii) to calculate the total for each hand according to the rules of Baccarat, (iii) to determine which, if any hand is entitled to receive a third card according to the rules of Baccarat, (iv) to control the display to display an indication which hand is to receive a third card, (v) to, if a third card is dealt recalculate the hand totals, (vi) to determine which hand has won or whether the outcome is a tie and to control the display to indicate the outcome of the game and (vii) to display a historical record of a plurality of hands.

26. The system of claim 25 wherein said processor controls the display to display the historical record in one of a column, streak or tally format.

27. The system of claim 25 wherein said processor drives the display to initially display card representations and the outcome for the game and to thereafter display said historical record including the outcome of the last game.

28. The system of claim 25 wherein said processor determines which winning hand won with a Natural and controls the display to display at the historical record which hands won with a Natural.

* * * * *